US005616878A

United States Patent [19]

Lee et al.

[11] Patent Number: 5,616,878

[45] Date of Patent: Apr. 1, 1997

[54] VIDEO-SONG ACCOMPANIMENT APPARATUS FOR REPRODUCING ACCOMPANIMENT SOUND OF PARTICULAR INSTRUMENT AND METHOD THEREFOR

[75] Inventors: Deok-hyun Lee, Seoul; Jae-yong Kang, Suwon-city, both of Rep. of Korea

[73] Assignee: Samsung Electronics Co., Ltd., Kyungki-do, Rep. of Korea

[21] Appl. No.: 458,238

[22] Filed: Jun. 2, 1995

[30] Foreign Application Priority Data

Jul. 26, 1994 [KR] Rep. of Korea ..... 94-18067

[51] Int. Cl.[6] ..... G10H 7/00

[52] U.S. Cl. ..... 84/645; 84/609

[58] Field of Search ..... 84/609, 610, 634, 84/645

[56] References Cited

U.S. PATENT DOCUMENTS

| | | | |
|---|---|---|---|
| 4,887,503 | 12/1989 | Suzuki . | |
| 5,119,711 | 6/1992 | Bell et al. | 84/645 X |
| 5,208,421 | 5/1993 | Lisle et al. | 84/645 |
| 5,225,618 | 7/1993 | Wadhams | 84/645 X |
| 5,247,126 | 9/1993 | Okamura et al. | 84/645 X |
| 5,355,762 | 10/1994 | Tabata | 84/615 X |
| 5,361,673 | 11/1994 | Kira et al. | 84/645 X |
| 5,410,100 | 4/1995 | Kim | 84/601 X |
| 5,454,723 | 10/1995 | Horii | 84/601 X |
| 5,484,291 | 1/1996 | Nakai et al. | 84/610 X |

*Primary Examiner*—William M. Shoop, Jr.
*Assistant Examiner*—Jeffrey W. Donels
*Attorney, Agent, or Firm*—Sughrue, Mion, Zinn, Macpeak & Seas

[57] ABSTRACT

A video-song accompaniment apparatus includes an accompaniment information memory storing accompaniment information of a song in a musical instrument digital interface (MIDI) format, a lyrics information memory storing lyrics information of the song, an accompaniment signal generator for generating an accompaniment signal according to the accompaniment information, a lyrics signal generator for generating a video character signal according to the lyrics information, a controller for providing the lyrics information to the lyrics signal generator and the accompaniment information to the accompaniment signal generator, respectively, to thereby generate the lyrics information in synchronization with the accompaniment information. The apparatus includes an instrument selector for input of instrument selection information to the controller. According to one aspect of the invention, the controller selectively outputs to the accompaniment signal generator only accompaniment information of the instrument selected by the instrument selection information, which is provided from the instrument selector, from among the accompaniment information read out from the accompaniment information memory. A method for generating accompaniment information for a single instrument is also described.

3 Claims, 2 Drawing Sheets

VIDEO-SONG ACCOMPANIMENT APPARATUS FOR REPRODUCING ACCOMPANIMENT SOUND OF PARTICULAR INSTRUMENT AND METHOD THEREFOR

BACKGROUND OF THE INVENTION

1. Field of the Invention

The present invention relates to a video-song accompaniment apparatus and, more particularly, to a video-song accompaniment apparatus for selectively reproducing an accompaniment sound of a particular instrument among accompaniment signals. A corresponding method for producing an accompaniment sound for a selected instrument is also disclosed.

2. Brief Discussion of Related Art

A video-song accompaniment apparatus, commonly called a karaoke machine, displays lyrics on a video display device while reproducing a song accompaniment, enabling a user viewing the displayed lyrics to sing the displayed song in time to the accompaniment.

Although the majority of karaoke machines are based on laser disk players, there has been an increase in the number of video-song accompaniment apparatuses using a combination of semiconductor memory for lyrics storage, and a compact disk, which stores digital accompaniment data. Instead of using a laser disk to record sampled analog accompaniment signal, the current generation of karaoke machines use musical instrument digital interface (MIDI) data as digital accompaniment data. Such a video-song accompaniment apparatus using the MIDI data can also be used as an apparatus for accompaniment exercises, due to the simple operation of repeating a song accompaniment.

However, in the case of a conventional video-song accompaniment apparatus having no function for selectively reproducing a particular instrument sound, a user cannot practice playing an accompaniment while listening to a selected instrument sound.

SUMMARY OF THE INVENTION

The present invention was motivated by a desire to the above-described problem. .

An object of the present invention to provide a video-song accompaniment apparatus for selectively reproducing a particular instrument sound from among accompaniment signals.

This and other objects, features and advantages according to the present invention are provided by a video-song accompaniment apparatus. The apparatus includes an accompaniment information memory in which accompaniment information of a song in a MIDI format is stored; a lyrics information memory in which lyrics information of the song is stored; an accompaniment signal generator for generating an accompaniment signal according to the accompaniment information read out from the accompaniment information memory; a lyrics signal generator for generating a video character signal according to the lyrics information read out from the lyrics information memory; and a controller for providing the lyrics information read out from the lyrics information memory to the lyrics signal generator and the accompaniment information from the accompaniment information memory to the accompaniment signal generator, respectively, and controlling a generating operation of the lyrics information in synchronization with the accompaniment information. Advantageously the apparatus also includes an instrument selector for inputting instrument selection information.

According to one aspect of the invention, the controller selectively outputs to the accompaniment signal generator an accompaniment information of the instrument selected by the instrument selection information provided from the instrument selector, among the accompaniment information read out from the accompaniment information memory.

A corresponding method for operating the video-song accompaniment apparatus is also disclosed.

BRIEF DESCRIPTION OF THE DRAWINGS

The above objects of the present invention will become more apparent by describing in detail a preferred embodiment thereof with reference to the attached drawings in which.

DETAILED DESCRIPTION OF THE PREFERRED EMBODIMENT

Figure 1:
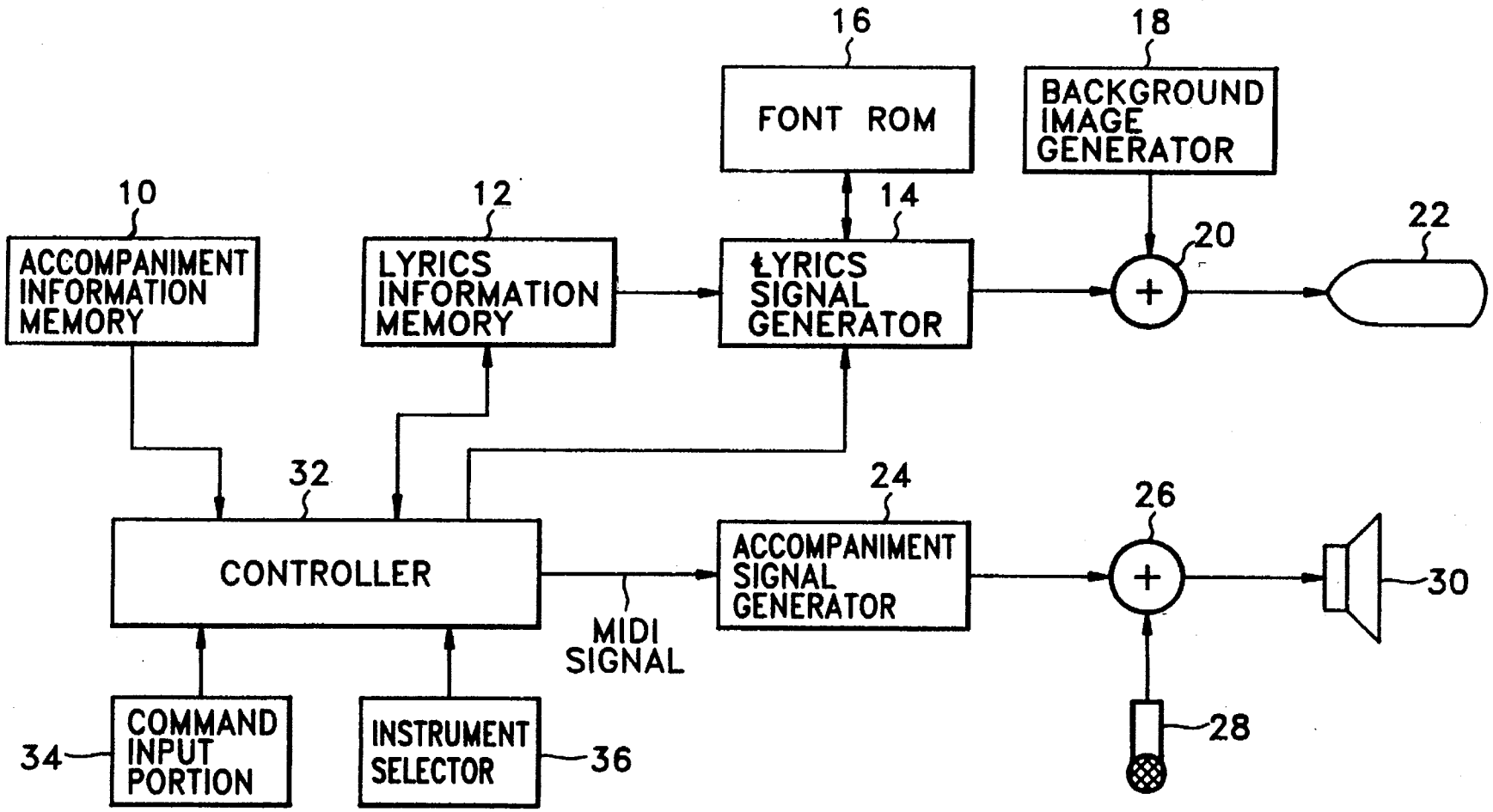
FIG. 1 is a block diagram illustrating a video-song accompaniment apparatus according to the present invention.

FIG. 1 is a block diagram illustrating a video-song accompaniment apparatus according to the present invention. As shown in FIG. 1, a controller 32 is connected to both an accompaniment information memory 10, which stores the accompaniment information of plural instruments according to the musical instrument digital interface (MIDI) standard, and a lyrics information memory 12 storing lyrics information. Preferably, the memory 10 may be a compact disk and in an exemplary case may be a so-called CD-ROM. It will also be noted that the lyrics information memory 12 can be any of the known types of semiconductor memories. Advantageously, memory 12 can be a non-volatile semiconductor memory.

A lyrics signal generator 14 converts and stores lyrics information received from the lyrics information memory 12 into a video signal having a bit map font and outputs the converted lyrics information as the lyrics signal sequence to a video mixer 20. Preferably, a font ROM 16 for storing a bit map font is operatively connected to signal generator 14. Video mixer 20 advantageously includes two input terminals, one connected to signal generator 14 and one connected to a background image generator 18, the latter generating a background image for display on monitor 22. In will be appreciated that video mixer 20 mixes a first video signal representing the lyrics signal sequence provided by lyrics signal generator 14 with a second video signal generated by background image generator 18.

Controller 32 is also connected to an accompaniment signal generator 24, which is used for generating an accompaniment signal based on the accompaniment information representing each instrument, which information is stored in memory 10. An audio mixer 26 mixes an accompaniment signal generated by accompaniment signal generator 24 with a voice signal generated by a microphone 28 and outputs this mixed acoustic signal to an output device, e.g., a speaker 30.

As discussed immediately above, controller 32 reads out the accompaniment information stored in accompaniment information memory 10 and provides the read signal to accompaniment signal generator 24. Preferably, controller 32 regulates the display of lyrics information by controlling both lyrics information memory 12 and lyrics signal generator 14. Advantageously, controller 32 controls memory 12 and generator 14 in accordance with lyrics display control information stored in accompaniment information memory 10. Reference numeral 34 refers to a command input portion for designating a song program selection, as well as reservation, reproduction, and instrument selection functions.

The accompaniment information is composed of MIDI data, i.e., a MIDI signal. Table 1 shows an exemplary MIDI signal data format.

TABLE 1

| | | STATUS BYTE | NUMBER OF DATA BYTES |
|---|---|---|---|
| CHANNEL MESSAGE | Note OFF | 8X | 2 |
| | Note ON | 9X | 2 |
| | Poly Phonic Key Pressure | AX | 2 |
| | Control Change | BX | 2 |
| | Program Pressure | CX | 1 |
| | Channel Pressure | DX | 1 |
| | Pitch Foil Change | EX | 2 |
| SYSTEM MESSAGE | Exclusive Change | F0 | arbitrary |
| | Cutter Frame Change | F1 | 1 |
| | Song Position Pointer | F2 | 2 |
| | Song Selector | F3 | 1 |
| | Tune Request | F6 | nonexistent |
| | End of Exclusive | F7 | nonexistent |
| | Timing Clock | F8 | nonexistent |
| | Start | FA | nonexistent |
| | Continue | FB | nonexistent |
| | Stop | FC | nonexistent |
| | Active Sensing | FE | nonexistent |
| | System Reset | FF | nonexistent |

The MIDI signal is composed of a "status byte" which is, in an exemplary case, one byte long, and "data bytes", which are more than one byte long. The MIDI signal is largely divided into a channel message and a system message in accordance with the status byte. The channel message is especially divided into a voice message and a mode message, while the system message maybe divided into an exclusive message, a common message, or a real-time message. The channel message, as shown in FIG. 2, indicates the start and stop of a note from a predetermined instrument, i.e., channel, with a predetermined note tone and associated stress.

Figure 2:
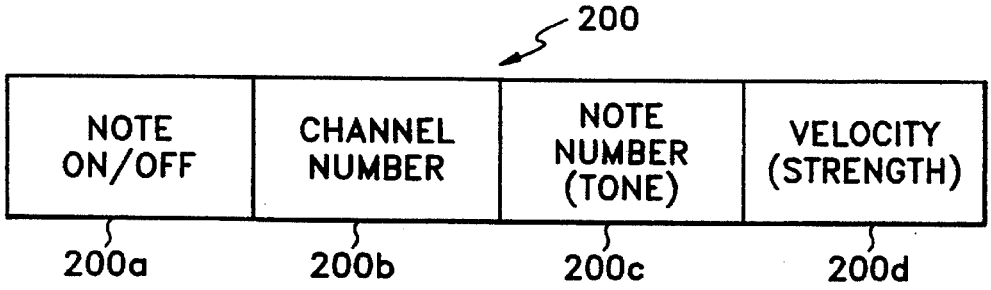
FIG. 2 is a view illustrating a data format of a channel message among MIDI signals.

In FIG. 2, the data format of the channel message in the MIDI data is illustrated. Advantageously, channel message 200 has note on/off data 200*a*, channel number data 200*b*, note number data 200*c*, and velocity data 200*d*. Note on/off data 200*a* is a 4-bit signal for controlling turning on/off operation of a selected note of an instrument, which instrument is designated by channel number data 200*b*, and note number data 200*c* following note on/off data 200*a*. Channel number data 200*b* advantageously may be a 4-bit signal for determining an instrument sound generated from accompaniment signal generator 24. It will be appreciated that when the data is a 4-bit signal, a maximum of sixteen instruments can be designated by channel data 200*b*. Note number data 200*c* indicates a tone of the instrument designated by channel number data 200*b*. Velocity data 200*d* describes the stress of the designated note.

In the present invention, when a channel message is transmitted to accompaniment signal generator 24, the channel number data 200*b* in the channel message is interpreted by referring to the instrument selection information. Advantageously, instrument selector 36 is configured to receive numerals 0 through 15 input by a user through numeric keys (not shown). Preferably, the numerals 0 through 15 can be input in hexadecimal form, e.g., numbers 0 through F, although the numerals could be input by a selection dial. The channel number 200*b* selected by instrument selector 36 is used in the production of accompaniment information by controller 32, as discussed in greater detail below.

Figure 3:
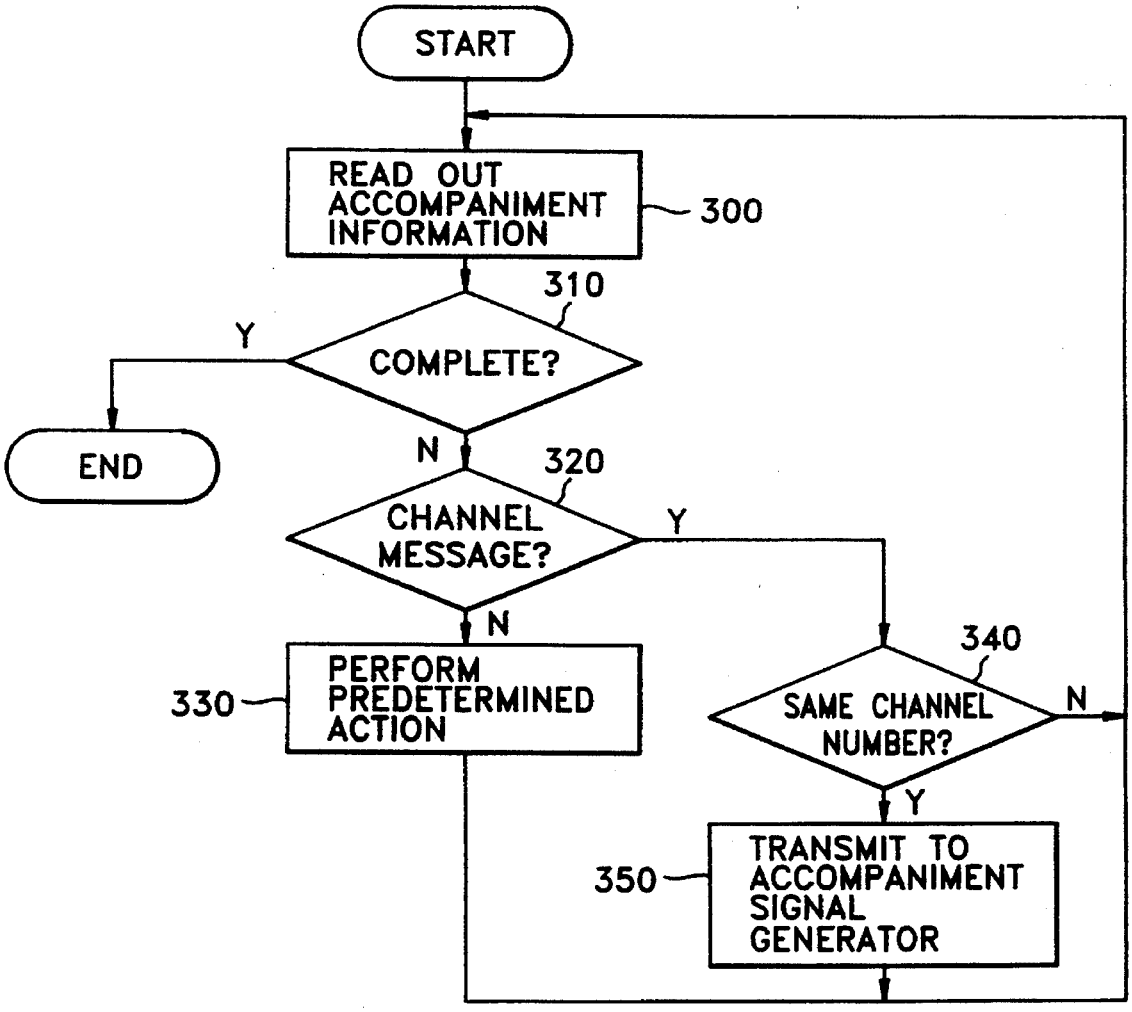
FIG. 3 is a flowchart illustrating an instrument selecting operation by the controller shown in FIG. 1.

FIG. 3 is a flowchart illustrating an exemplary instrument selecting operation performed controller 32 in FIG. 1.

In step 300, accompaniment information stored in accompaniment information memory 10 is first read out, byte by byte, in order to generate an accompaniment signal or to control the display of a lyrics character. In step 310, it is determined whether a data read-out process is completed. When the data read-out process has been completed, the whole process ends. However, when the results of step 310 are negative, step 320 is executed. In step 320, it is determined whether the read-out data is a channel message. When the read-out data is not channel message, a predetermined operation is performed during step 330 and the process then returns to step 300. If the data in step 320 is the channel message, the channel data 200*b* among the channel message is compared to the channel number selected by instrument selector 36 during step 340. When the channel data 200*b* of the channel message 200 is the same as the selected channel number output by instrument selector 36, the channel message is transmitted to accompaniment signal generator 24 during step 350. However, if channel data 200*b* is not the same as the selected channel number, the process returns to step 300, discarding the channel message.

In the exemplary operating sequence shown in FIG. 3, the case wherein a single channel number is selected is illustrated. It will be appreciated that this sequence can be also applied equally to the case where multiple channel numbers are selected. Preferably, controller 32 checks the selected channel information against the channel data 200*b* in the channel message 200 and, if a match occurs, outputs the information to accompaniment signal generator 24. However, the channel data 200*b* can be unconditionally replaced with the selected channel number.

As described above, a video-song accompaniment apparatus according to the present invention selectively reproduces a particular instrument sound, by providing a channel message to the accompaniment signal generator which has a channel number 200*b* coincident with a value selected using instrument selector 36.

Other modifications and variations to the invention will be apparent to those skilled in the art from the foregoing disclosure and teachings. Thus, while only certain embodiments of the invention have been specifically described herein, it will be apparent that numerous modifications may be made thereto without departing from the spirit and scope of the invention.

What is claimed is:

1. A video-song accompaniment apparatus comprising:

an accompaniment information memory in which accompaniment information for a song in a musical instrument digital interface (MIDI) format is stored;

a lyrics information memory in which lyrics information for the song is stored;

an accompaniment signal generator for generating an accompaniment signal according to the accompaniment information read out from said accompaniment information memory;

a lyrics signal generator for generating a video character signal according to the lyrics information read out from said lyrics information memory;

a controller for providing the lyrics information read out from said lyrics information memory to said lyrics signal generator and the accompaniment information read out from said accompaniment information memory to said accompaniment signal generator, respectively, and for controlling a generating operation of the lyrics information in synchronization with the accompaniment information; and an instrument selector for providing instrument selection information to said controller, wherein said controller selectively outputs to said accompaniment signal generator selected accompaniment information, corresponding to the respective instrument selected by the instrument selection information provided from said instrument selector, from among the accompaniment information read out from said accompaniment information memory.

2. A song accompaniment apparatus comprising:

an accompaniment information memory storing accompaniment information of a song in a musical instrument digital interface (MIDI) format;

an accompaniment signal generator generating an accompaniment signal according to the accompaniment information read out from said accompaniment information memory;

a controller for controlling operation of said accompaniment signal generator responsive to the accompaniment information, by reading out the accompaniment information from said accompaniment information memory and providing the read out information to said accompaniment signal generator; and an instrument selector for providing instrument selection information to said controller, wherein said controller selectively outputs selected accompaniment information to said accompaniment signal generator, said selected accompaniment information representing an instrument selected by the instrument selection information provided from said instrument selector, from among the accompaniment information read out from said accompaniment information memory.

3. A method for generating a selected instrument accompaniment signal using a song accompaniment apparatus having an accompaniment information memory storing accompaniment information of a song in a musical instrument digital interface (MIDI) format, an accompaniment signal generator generating an accompaniment signal according to the accompaniment information, a controller for controlling operation of the accompaniment signal generator responsive to the accompaniment information, and an instrument selector for providing instrument selection information to the controller, said method comprising the steps of:

(a) selecting a channel number representing a selected instrument, (b) comparing said channel number to channel data including a plurality of numerals corresponding to a plurality of individual instruments, respectively; and (c) controlling the accompaniment signal generator so as to generate an accompaniment signal corresponding to the selected instrument from among the accompaniment information read out from said accompaniment information memory when said channel number is coincident with one of said numerals representing the selected instrument.

* * * * *